US005462430A

United States Patent [19]

Khinkis

[11] Patent Number: 5,462,430

[45] Date of Patent: Oct. 31, 1995

[54] PROCESS AND APPARATUS FOR CYCLONIC COMBUSTION

[75] Inventor: Mark J. Khinkis, Morton Grove, Ill.

[73] Assignee: Institute of Gas Technology, Des Plaines, Ill.

[21] Appl. No.: 11,670

[22] Filed: Jan. 29, 1993

Related U.S. Application Data

[63] Continuation-in-part of Ser. No. 704,817, May 23, 1991, abandoned.

[51] Int. Cl.[6] ..... F23M 3/14; F23C 9/06

[52] U.S. Cl. ..... 431/10; 431/9; 431/173; 431/116; 431/351; 122/18; 122/250 R

[58] Field of Search ..... 431/9, 353, 10, 431/115, 116, 173, 350, 351; 112/14, 18, 248, 249, 250 R; 60/732

[56] References Cited

U.S. PATENT DOCUMENTS

| | | | |
|---|---|---|---|
| 2,097,255 | 10/1937 | Saha . | |
| 2,808,012 | 10/1957 | Schindler | 431/173 X |
| 3,030,773 | 4/1962 | Johnson . | |
| 3,389,692 | 6/1968 | Johnson et al. . | |
| 3,741,166 | 6/1973 | Bailey . | |
| 3,837,788 | 9/1974 | Craig et al. . | |
| 3,859,786 | 1/1975 | Azelborn et al. . | |
| 3,885,906 | 5/1975 | Shurygin et al. . | |
| 3,915,619 | 10/1975 | Quigg et al. | 431/10 |
| 3,934,555 | 1/1976 | Baumgartner et al. . | |
| 3,969,482 | 7/1976 | Teller . | |
| 3,974,021 | 8/1976 | Bernadiner et al. . | |
| 4,007,001 | 2/1977 | Schirmer et al. . | |
| 4,021,188 | 5/1977 | Yamagishi et al. . | |
| 4,144,019 | 3/1979 | Lyshkow et al. | 431/173 |
| 4,297,093 | 10/1981 | Morimoto et al. . | |
| 4,395,223 | 7/1983 | Okigami et al. . | |
| 4,575,332 | 3/1986 | Oppenberg et al. . | |
| 4,714,032 | 12/1987 | Dickinson . | |
| 4,784,600 | 11/1988 | Moreno | 431/9 |
| 4,860,695 | 8/1989 | Korenberg . | |
| 4,867,674 | 9/1989 | Keller et al. | 431/351 |
| 4,879,959 | 11/1989 | Korenberg . | |
| 4,920,925 | 5/1990 | Korenberg et al. . | |
| 4,989,549 | 2/1991 | Korenberg . | |
| 5,029,557 | 7/1991 | Korenberg . | |

FOREIGN PATENT DOCUMENTS

| | | |
|---|---|---|
| 9110864 | 7/1991 | WIPO . |

*Primary Examiner*—Carl D. Price
*Attorney, Agent, or Firm*—Speckman, Pauley & Fejer

[57] ABSTRACT

A process and apparatus for cyclonic combustion with ultra-low pollutant emissions and high efficiency wherein a fuel and primary combustion air mixture is tangentially injected into a reducing primary combustion zone of a cyclonic combustor. The primary combustion air is injected into the reducing primary combustion zone in an amount equal to between about 30% and about 90% of a stoichiometric requirement for complete combustion of the fuel. Secondary combustion air is tangentially injected into an oxidizing secondary combustion zone of the cyclonic combustor, in an amount equal to between about 10% and about 90% of the stoichiometric requirement for complete combustion of the fuel. Primary combustion products from the reducing primary combustion zone are mixed with the tangentially injected secondary air for completing combustion within the oxidizing secondary combustion zone. Combustion chamber walls which define the reducing primary combustion zone and the oxidizing secondary combustion zone are water-cooled.

22 Claims, 4 Drawing Sheets

PROCESS AND APPARATUS FOR CYCLONIC COMBUSTION

CROSS REFERENCE TO RELATED APPLICATION

This application is a continuation-in-part of U.S. patent application Ser. No. 07/704,817, filed May 23, 1991, now abandoned.

BACKGROUND OF THE INVENTION

1. Field of the Invention

This invention relates to a process and apparatus for cyclonic combustion of fossil fuels, in particular natural gas, in a combustion chamber with cooled walls, which provides ultra-low pollutant emissions as well as high system efficiencies in watertube boilers, water heaters, and other similar devices. The combustion chamber is enveloped by a cooling fluid conduit and cooled by a cooling fluid circulating through the conduit.

2. Description of the Prior Art

Conventional combustion of fossil fuels with air produces elevated temperatures which promote complex chemical reactions between oxygen and nitrogen in the air forming various oxides of nitrogen as by-products of the combustion process. These oxides, containing nitrogen in different oxidation states, generally are grouped together under the single designation of $NO_x$. Concern over the role of $NO_x$ and other combustion by-products, such as sulfur dioxide and carbon monoxide, in "acid rain" and other environmental problems is generating considerable interest in reducing the formation of these environmentally harmful by-products of combustion.

U.S. Pat. No. 3,934,555 discloses a cast iron modular boiler having a cylindrical combustion chamber where a mixture of gaseous fuel and air is introduced in a rotational flow around its longitudinal axis. The combustion gases are recirculated internally, thereby causing dilution of gases in the boiler. The combustion chamber is encircled by a water circulation conduit and cooled by a stream of cold water that circulates through the conduit. Heat is removed from the combustion chamber as hot water.

U.S. Pat. No. 4,714,032 teaches combustion of solid fuels charged as aqueous slurries with recirculation of condensate containing particles of ash, alkali, and spent alkali by charging such condensate to an elongated entrained phase combustion reactor. Hot, dry compressed air is injected as primary and/or secondary air into the reactor. A portion of heat liberated in the combustion zone is used to vaporize the fuel slurry water. The remainder of heat which must be absorbed to reduce the combustion temperature is extracted through a heat transfer surface in the combustion zone or absorbed by latent heat of recycled water or slurry, or by a combination of both methods.

U.S. Pat. No. 3,969,482 discloses a process for treating effluent gases containing high concentrations of sulfur oxides, nitrogen oxides, hydrogen halides, silicon tetrafluoride, and mixtures thereof. Effluent gases are treated to remove a portion of acidic gases by spraying an aqueous solution or slurry into the effluent gases.

U.S. Pat. No. 4,007,001 teaches combustion producing low $NO_x$ by tangentially introducing to a first combustion zone of 0 to 65 percent of the total air and about 5 to 25 percent of the total air to a secondary combustion zone wherein there is an orifice between the primary and secondary combustion zones. U.S. Pat. No. 3,859,786 teaches a vortex flow combustor having a restricted exit from the combustion chamber.

U.S. Pat. No. 4,021,188 and U.S. Pat. No. 3,837,788 both teach staged combustion with less than the stoichiometric amount of air in the primary combustion chamber with additional air being added to the secondary combustion chamber for completion of combustion. U.S. Pat. No. 4,575,332 teaches staged combustion in a swirl combustor with forced annular recycle of flue gas to the upstream end of the primary combustion zone.

U.S. Pat. No. 4,395,223 discloses staged combustion with excess air introduced into the primary combustion zone with additional fuel being introduced into the secondary combustion zone. U.S. Pat. No. 3,741,166 discloses a blue flame burner with recycle of combustion products with low excess air to produce low $NO_x$ while U.S. Pat. No. 4,297,093 discloses a single combustion chamber with a specific flow pattern of fuel and combustion air forming fuel-rich primary zones and fuel-lean secondary zones in the combustion chamber.

U.S. Pat. No. 4,920,925 teaches a cyclonic combustor for boilers having an uncooled primary combustion chamber, a secondary combustion chamber in communication with said primary combustion chamber, ducts for supplying fuel and combustion air directly into the primary combustion chamber and for forming a cyclonic flow pattern of hot gases for combustion within the primary and secondary combustion chanbers, an orifice disposed at the downstream end of the secondary combustion chamber, and a heat exchanger surrounding the second combustion chamber for removing heat therefrom.

U.S. Pat. No. 4,989,549 teaches a combustion apparatus for staged combustion inside the Morison tube of a firetube boiler, the first stage being substoichiometric combustion and the second stage being above-stoichiometric combustion. In accordance with one embodiment, an elongated orifice into which secondary combustion air is injected is disposed between the primary combustion zone and the secondary combustion zone and a swirler is disposed at the downstream end of the secondary combustion zone. In accordance with a second embodiment, the downstream end of the primary combustion chamber is closed off by a refractory wall and extends into the upstream end of the secondary combustion chamber. Axially disposed openings in the side wall of the primary combustion chamber permit passage of the products of combustion from the primary combustion chamber into the secondary combustion chamber. An orifice is disposed at the exit end of the secondary combustion zone through which gases from the secondary combustion chamber are exhausted.

SUMMARY OF THE INVENTION

It is one object of this invention to provide a process for cyclonic combustion which produces ultra-low pollutant emissions at a high system efficiency.

It is another object of this invention to provide a process for cyclonic combustion wherein the combustion chamber walls are cooled by a cooling fluid.

It is another object of this invention to provide a process for cyclonic combustion wherein high heat transfer rates from combustion products to the combustion chamber walls are maintained.

It is another object of this invention to provide a process for cyclonic combustion wherein relatively cool products of combustion, including products of both incomplete and complete combustion, are recirculated to a first, or primary, combustion zone into which fuel and primary combustion air are injected tangentially.

It is yet another object of this invention to provide a process for cyclonic combustion wherein relatively cool products of combustion, including products of both incomplete and complete combustion, are recirculated to a second, or secondary, combustion zone into which secondary combustion air is injected tangentially.

It is still another object of this invention to provide an apparatus which accommodates the process for cyclonic combustion, as herein described.

The above objects of this invention are achieved by a process for cyclonic combustion in a combustor with fluid-cooled walls having high heat transfer rates to the walls, ultra-low pollutant emissions, and high system efficiency, beginning with the step of tangentially injecting fuel into a primary combustion zone of a cyclonic combustion chamber in a combustor. Primary combustion air also is injected tangentially into the primary combustion zone, preferably in an amount equal to about 30% to about 90% of a stoichiometric requirement for combustion of the fuel, forming a reducing atmosphere within the primary combustion zone. For purposes of this disclosure, the primary combustion zone as used in the specification and claims is a reducing zone. A fuel-rich primary combustion air/fuel mixture is formed by the fuel and the primary combustion air. The fuel-rich primary combustion air/fuel mixture is burned within the primary combustion zone, forming primary combustion products, primarily products of incomplete combustion. The primary combustion products are passed through a water-cooled primary orifice disposed between the primary combustion zone and a secondary combustion zone downstream of said primary combustion zone. Secondary combustion air, in an amount equal to about 10% to about 90% of the stoichiometric requirement, is tangentially injected into the secondary combustion zone downstream of the primary orifice, forming an oxidizing secondary combustion zone. Combustion is completed in the secondary combustion zone, forming exhaust gases which are exhausted through a secondary orifice at the downstream end of the secondary combustion zone. To maintain temperatures within the combustor below the level required for $NO_x$ formation, both the primary and secondary combustion zones as well as the primary orifice are fluid-cooled, preferably with water.

In a preferred embodiment of this invention, fuel, preferably natural gas, is premixed with primary combustion air and the resulting fuel-rich primary combustion air/fuel mixture is injected tangentially into the primary combustion zone of the cyclonic combustion chamber.

In another preferred embodiment of this invention, relatively cool exhaust gases are recirculated from the discharge end of the secondary combustion zone back to the primary combustion zone.

In still another embodiment of this invention, a primary refractory ring is mounted on an inside surface of the cyclonic combustion chamber side walls upstream of the secondary combustion zone and near the front wall of the cyclonic combustor. A tangentially injected primary combustion air/fuel mixture is passed over the primary refractory ring which provides stabilization of the flame within the primary combustion zone.

In yet another embodiment in accordance with this invention, a secondary refractory ring is mounted on the inside surface of the secondary combustion chamber side walls, downstream from the primary orifice. The products of combustion discharging from the primary combustion zone through the primary orifice into the secondary combustion zone are mixed with the tangentially injected secondary combustion air and passed over the secondary refractory ring which provides stabilization of the flame within the secondary combustion zone.

The apparatus of the water-cooled cyclonic combustor in accordance with one embodiment of this invention comprises at least one combustion chamber side wall secured to a combustion chamber front wall, both of which define a cyclonic combustion chamber which is comprised of the primary combustion zone and the secondary combustion zone. Each combustion chamber sidewall comprises fluid-cooling conduits for accommodating cooling fluid flow, preferably water, through at least a portion thereof.

A primary orifice wall having a primary orifice is secured to the combustion chamber side wall, between the primary combustion zone and the secondary combustion zone, separating the cyclonic combustion chamber into a primary combustion chamber and a secondary combustion chamber. A secondary orifice is secured to the combustion chamber side wall at or near a discharge end of the secondary combustion chamber. The primary orifice wall comprises means for cooling, preferably in the form of cooling water conduits through which feedwater is circulated.

The apparatus for cyclonic combustion in accordance with this invention further comprises primary tangential injection means for tangentially injecting fuel and primary combustion air into said primary combustion zone and secondary tangential injection means for tangentially injecting secondary combustion air into said secondary combustion zone.

In accordance with one embodiment of this invention, said primary tangential injection means comprises at least one primary nozzle secured to the combustion chamber side wall and in communication with the primary combustion zone.

In accordance with one embodiment of this invention, said secondary tangential injection means comprises at least one secondary nozzle secured to the combustion chamber side wall and in communication with the secondary combustion zone.

To provide cooling water to the water-cooling conduits of the combustion chamber side walls, the combustion chamber front wall and the primary orifice wall, a pump or other forced feedwater circulating system is provided. A natural feedwater circulating system that utilizes gravity feed and the pressures generated within the feedwater-steam mixture may also be used to circulate feedwater.

In a preferred embodiment according to this invention, the combustion chamber side wall has an inlet opening for admitting recirculated exhaust products discharged through the secondary orifice back into the secondary combustion zone.

BRIEF DESCRIPTION OF THE DRAWINGS

The above and further objects and advantages of this invention will be better understood from the detailed description of preferred embodiments in conjunction with the drawings wherein.

DESCRIPTION OF PREFERRED EMBODIMENTS

Cyclonic combustor 15, according to this invention, is designed to produce ultra-low pollutant emissions utilizing two-stage combustion of fossil fuel wherein the combustion air required for complete combustion of the fossil fuel, preferably natural gas, is introduced into the combustion chamber in stages. Approximately 30% to about 90% of the stoichiometric requirement of combustion air for complete combustion of the fossil fuel, that is, primary combustion air, is introduced into the cyclonic first stage producing a reducing primary combustion zone. Approximately 10% to about 90% of the stoichiometric requirement of combustion air for complete combustion of the fossil fuel, that is, secondary combustion air, is introduced into the cyclonic second stage producing an oxidizing secondary combustion zone.

In a preferred embodiment of this invention, the primary combustion air is premixed with the fossil fuel producing a primary combustion air/fuel mixture, which mixture is injected tangentially into the cyclonic combustor into the reducing primary combustion zone. Secondary combustion air is injected tangentially into the oxidizing secondary combustion zone for complete combustion of the fuel with high intensity, high heat transfer rates to the walls, low excess air, preferably below about 5% and resulting in ultra-low pollutant emissions, with $NO_x$ less than about 15 vppm, carbon monoxide (CO) equal to or less than about 30 vppm, and total hydrocarbons (THC) equal to or less than about 5 vppm.

To maintain relatively low temperatures within the cyclonic combustor, the combustion chamber side wall defining the primary and secondary combustion zones and a primary orifice wall disposed between said primary and secondary combustion zones are fluid cooled, preferably by water.

In a preferred embodiment of this invention, relatively low temperatures are also maintained within the cyclonic combustor by recirculating low temperature exhaust gases from the secondary combustion zone of the cyclonic combustion chamber. Such low-temperature combustion results in even lower $NO_x$ emissions, typically below about 10 vppm.

Figure 1:
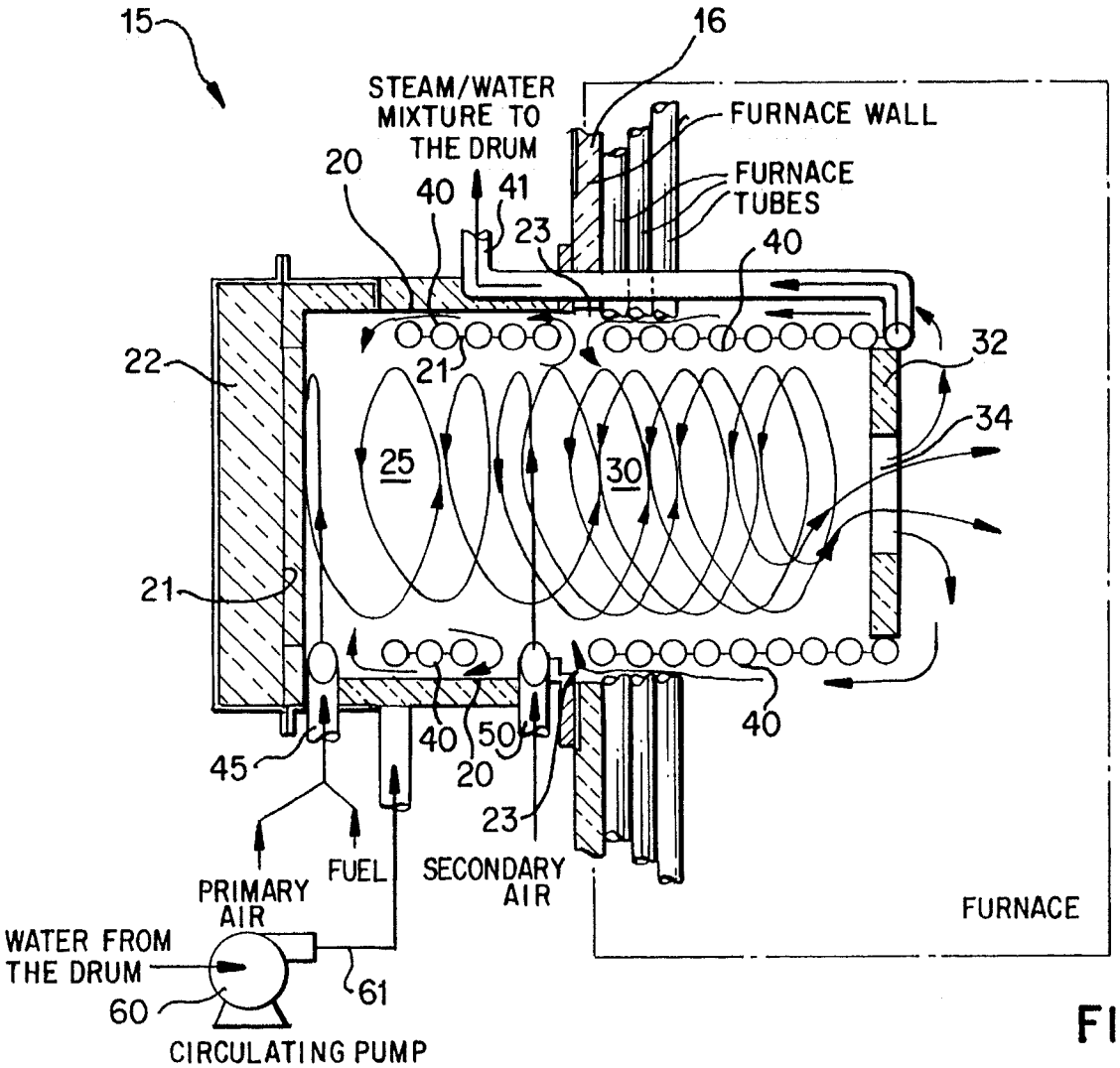
FIG. 1 is a cross-sectional side view of a cyclonic combustor in accordance with one embodiment of this invention.

The process for cyclonic combustion, with ultra-low pollutant emissions and high-efficiency, in accordance with this invention begins with tangentially injecting fuel, preferably natural gas, into primary combustion zone 25 of cyclonic combustor 15 as shown in FIG. 1. Primary combustion air is also tangentially injected into primary combustion zone 25, preferably in an amount equal to about 30% to about 90% of the stoichiometric requirement for complete combustion of the fuel, producing a reducing atmosphere within primary combustion zone 25. In a preferred embodiment of this invention, the fuel is premixed with the primary combustion air prior to injection into primary combustion zone 25. However, it is apparent that the fuel and primary combustion air can be separately introduced into primary combustion zone 25, as long as the tangential injection creates adequate swirl for proper mixing and the desired combustion.

To complete combustion within secondary combustion zone 30, secondary combustion air is tangentially injected into secondary combustion zone 30 in an amount equal to about 10% to about 90% of the stoichiometric requirement for complete combustion of the fuel, producing an oxidizing atmosphere within secondary combustion zone 30.

Figure 2:
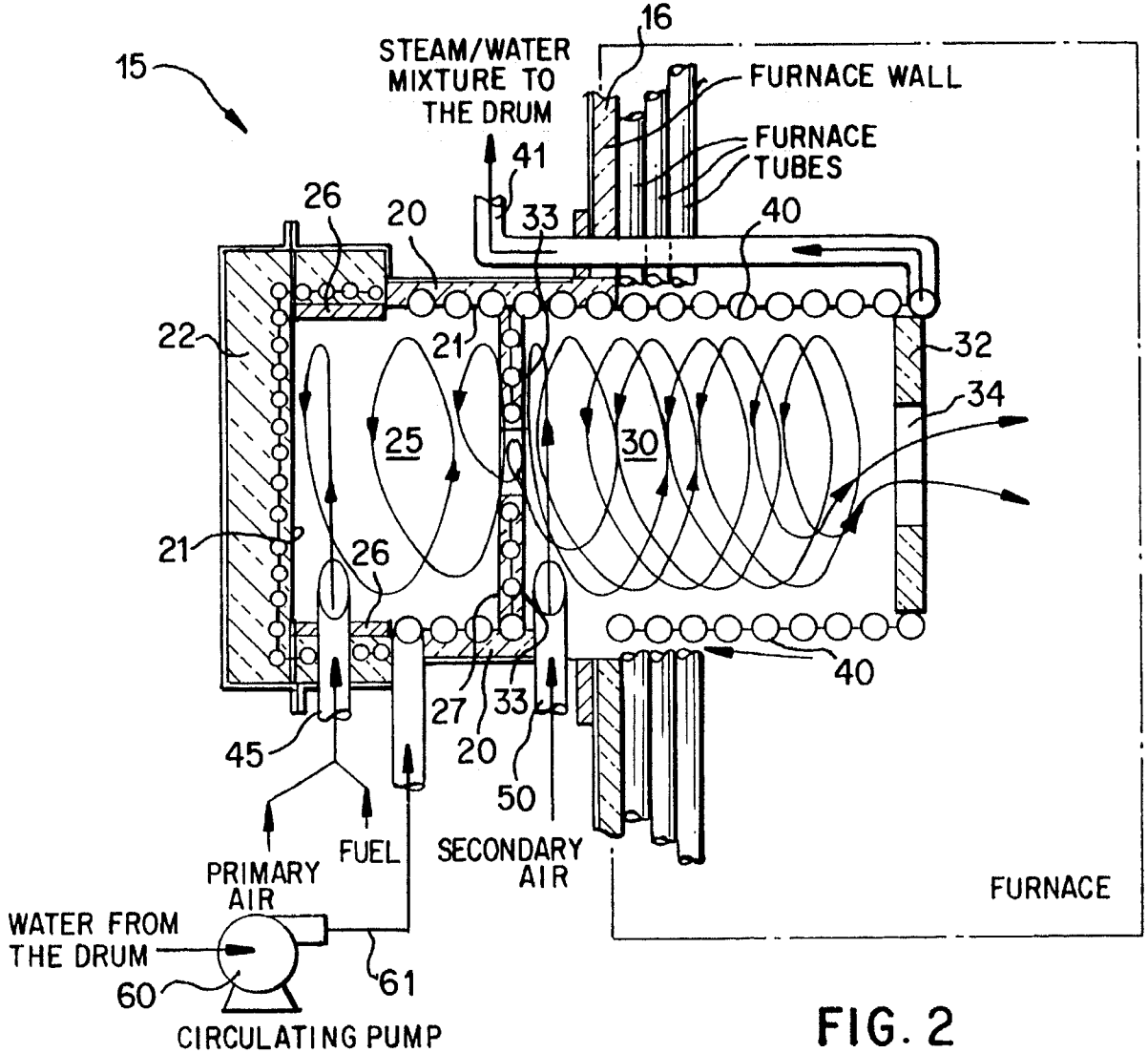
FIG. 2 is a cross-sectional side view of a cyclonic combustor having a refractory ring mounted within the primary combustion zone and a water-cooled primary orifice positioned between the primary combustion zone and the secondary combustion zone in accordance with one embodiment of this invention.

In one preferred embodiment according to this invention, the fuel and primary combustion air are tangentially injected into primary combustion zone 25 over primary refractory ring 26 as shown in FIG. 2. Primary refractory ring 26 is mounted on inside surface 21 of combustion chamber side walls 20, near combustion chamber front wall 22. Injection of the fuel and primary combustion air over primary refractory ring 26 enhances flame stabilization within cyclonic combustor 15.

Figure 4:
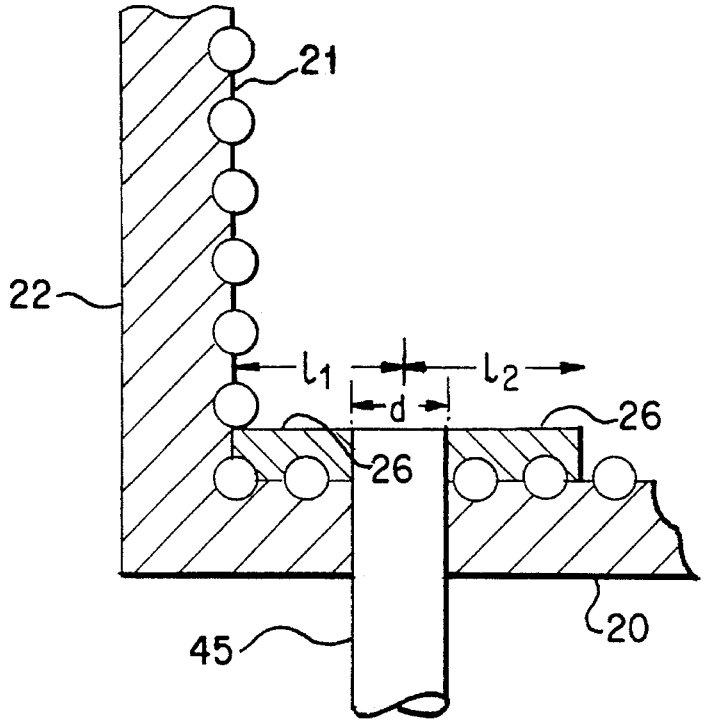
FIG. 4 is a partial cross-sectional view of a front wall and side wall configuration of a cyclonic combustor in accordance with one embodiment of this invention.

In another preferred embodiment according to this invention, the fuel and primary combustion air are tangentially injected into primary combustion zone 25 proximate combustion chamber front wall 22 which, in accordance with this embodiment of the invention, is water-cooled. To enhance a relatively low-temperature and stable combustion of the fuel and primary combustion air, it may be advantageous to tangentially inject the fuel and primary air at a specified distance from inside surface 21 of combustion chamber front wall 22. FIG. 4 illustrates how primary nozzle 45 protrudes through combustion chamber side wall 20, into primary combustion zone 25. The distance from inside surface 21 of combustion chamber front wall 22 to the centerline of primary nozzle 45 is represented by "$l_1$". The distance from a downstream edge of primary refractory ring 26 to the centerline of primary nozzle 45 is represented by "$l_2$". The inside diameter of primary nozzle 45 is represented by "d". In order to obtain maximum overall efficiency of cyclonic combustor 15, the ratio of $l_1$:d is between approximately 1.5 and 3.5. Likewise, for maximum overall efficiency, the ratio of $l_2$:d is between approximately 1.5 and 3.5.

Figure 3:
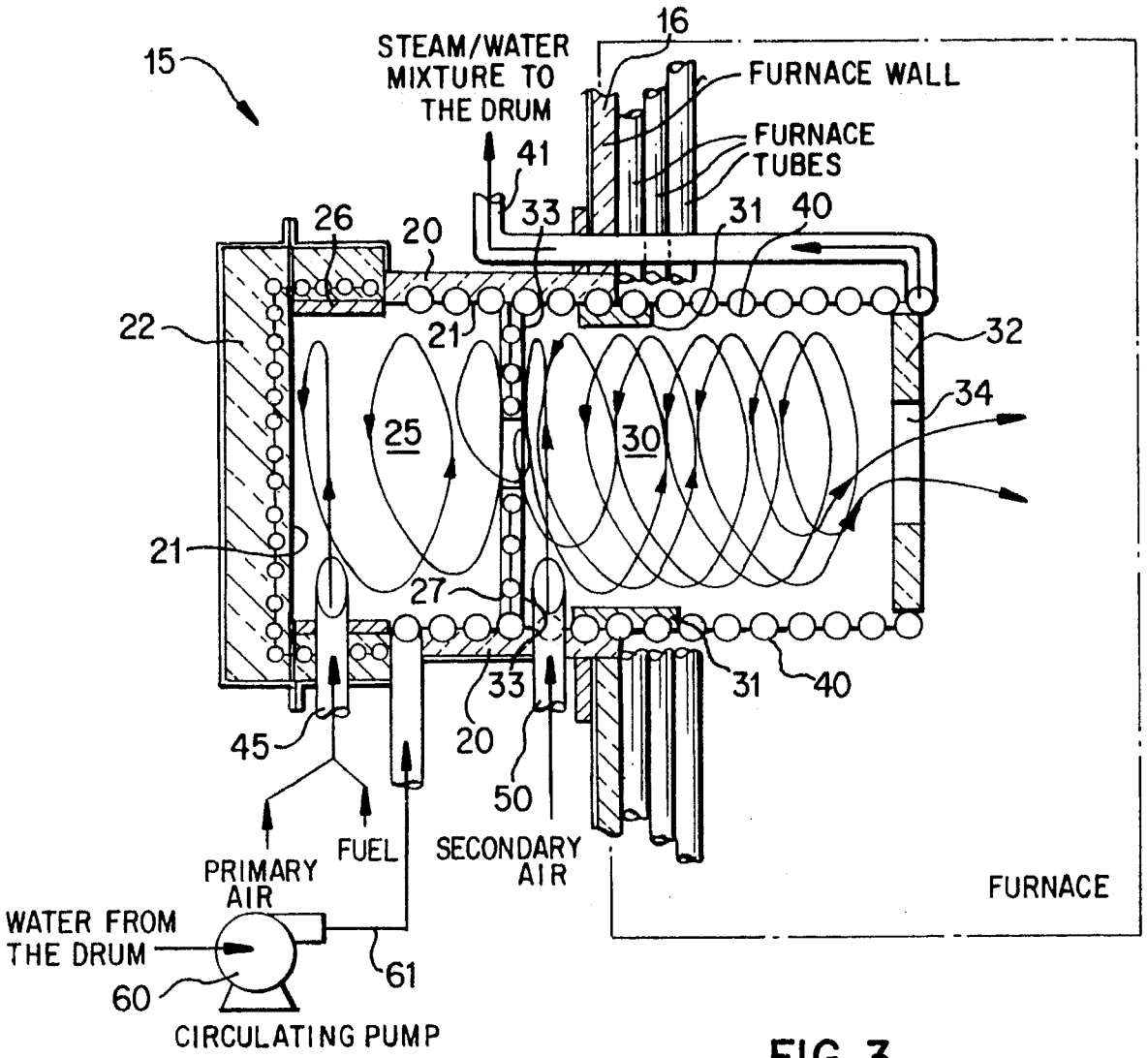
FIG. 3 is a cross-sectional side view of a cyclonic combustor having a primary refractory ring mounted within the primary combustion zone and a secondary refractory ring mounted within the secondary combustion zone in accordance with another embodiment of this invention.

Primary combustion products comprising carbon monoxide (CO), hydrogen ($H_2$) and some unburned fuel are discharged from primary combustion zone 25 through primary orifice 27 which is positioned within cyclonic combustor between primary combustion zone 25 and secondary combustion zone 30. In another preferred embodiment according to this invention, primary orifice 27 is water-cooled. The primary combustion products entering secondary combustion zone 30 are mixed with the tangentially injected secondary combustion air, and preferably passed over secondary refractory ring 31 as shown in FIG. 3, which is mounted on inside surface 21 of combustion chamber side walls Secondary refractory ring 31, like primary refractory ring 26, enhances flame stabilization within cyclonic combustor 15.

The exhaust gases from within secondary combustion zone 30 are passed through secondary orifice wall 32, which is mounted to combustion chamber side walls 20, downstream from a secondary point of injection of the secondary combustion air. The secondary point of injection is downstream from the location of primary orifice 27. Throughout this specification and the claims, the term "downstream" relates to the normal flow of fuel and air through cyclonic combustor 15, which enters primary nozzle 45 and exits through discharge opening 34 of secondary orifice wall 32. The secondary point of injection is also positioned at an exterior location, with respect to furnace wall 16, so that the secondary combustion air inlet enters cyclonic combustor 15 from outside of the furnace.

As shown in FIG. 1, combustion chamber wall 20 has inlet opening 23 through which exhaust gases discharged from cyclonic combustor 15 through discharge opening 34 of secondary orifice wall 32 are recirculated into secondary combustion zone 30 of cyclonic combustor 15. Recirculation occurs due to the negative pressures created along that portion of combustion chamber sidewall 20 extending into the furnace to which cyclonic combustor 15 is attached by the flow patterns of combustion products within the furnace and by the venturi effect created by the injection of secondary combustion air through secondary nozzle 50 positioned in combustion chamber side walls 20 upstream of and adjacent to inlet opening 23.

Primary nozzle 45 is positioned in combustion chamber side walls 20 adjacent to combustion chamber front wall 22. In addition, a portion of evaporative cooling coil 40 is positioned within primary combustion zone 25 such that combustion products from the discharge end of primary combustion zone 25 are recirculated along combustion chamber sidewall 20 as shown by arrows due to the negative pressure of the venturi effect from the injection of the fuel and primary combustion air through primary nozzle 45 into the inlet end of primary combustion zone 25.

FIG. 2 shows a preferred embodiment of this invention wherein, in addition to the features shown in FIG. 1, water-cooled primary orifice wall 27 is positioned inside cyclonic combustor 15 between primary combustion zone 25 and secondary combustion zone 30, creating, in effect, a primary combustion chamber and a secondary combustion chamber within cyclonic combustor 15. In still another preferred embodiment of this invention shown in FIG. 3, in addition to the features of the preferred embodiment shown in FIG. 2, secondary refractory ring 31 is positioned within secondary combustion zone 30 downstream of secondary nozzle 50. In addition, in both FIGS. 2 and 3, combustion chamber front wall 22 as well as combustion chamber side wall 20 are water-cooled. Water-cooling combustion chamber front wall 22 effectively lowers the combustion temperature within primary combustion zone 25, and thus produces reduced $NO_x$ emissions.

In all embodiments of this invention, at least one of combustion chamber side walls 20 is secured to combustion chamber front wall 22. It is apparent that combustion chamber side walls 20 can comprise either one generally cylindrical wall or multiple walls which are arranged to form cyclonic combustor 15. Regardless of how combustion chamber side walls 20 are arranged, it is important that the overall structure accommodate swirling flow through primary combustion zone 25 and secondary combustion zone 30.

In view of the high heat transfer rates from the combustion products to the walls generated by the cyclonic combustion process of this invention, water cooling is used to control the temperatures within primary combustion zone 25 and secondary combustion zone 30. Accordingly, in each embodiment of this invention, at least one combustion chamber side wall 20 has water-cooling means for accommodating feedwater flow through at least a portion of each combustion chamber side wall 20. In a preferred embodiment according to this invention, the water-cooling means includes evaporative cooling coil 40, as shown in FIGS. 1–5. It is apparent that evaporative cooling coil 40 can comprise one cooling coil or multiple cooling coils. It is also apparent that evaporative cooling coil 40 can be sized to produce various heat transfer rates. The heat transfer rate required, which in turn will determine the size and disposition of evaporative cooling coil 40 in cyclonic combustor 15, is a function of the size of cyclonic combustor 15 and the amount of fuel burned therein. Evaporative cooling coil 40 is preferably either secured to or adjacent inside surface 21 of combustion chamber side wall 20 and/or combustion chamber front wall 22. However, evaporative cooling coil 40 can also be housed within either combustion chamber side wall 20 or combustion chamber front wall 22. An inlet to evaporative cooling coil 40 is preferably in communication with a feedwater drum. Discharge nozzle 41 of evaporative cooling coil 40 is preferably in communication with the feedwater drum.

As previously stated, primary orifice wall 27 is secured to combustion chamber side wall 20 and positioned between primary combustion zone 25 and secondary combustion zone 30. Secondary orifice wall 32 is preferably secured to combustion chamber side wall 20 and positioned at or near discharge end 35 of secondary combustion zone 30. Primary orifice wall 27 may comprise a plate structure, a refractory structure, a wall of coiled tubes, a refractory wall with a cooling coil secured to the refractory wall, refractory louvers, water-cooled louvers, or another suitable structure for water-cooling the orifice.

Primary tangential injection means are secured to combustion chamber side wall 20 and in communication with primary combustion zone 25. According to a preferred embodiment of this invention, primary tangential injection means includes at least one primary nozzle 45 secured to combustion chamber side wall 20 and in communication with primary combustion zone 25. Each primary nozzle 45 is preferably positioned adjacent inside surface 21 of combustion chamber side wall 20 and off-center with respect to a centerline axis of primary combustion zone 25 on combustion chamber side wall 20.

Secondary tangential injection means are used to tangentially inject secondary combustion air into secondary combustion zone 30. In one preferred embodiment according to this invention, secondary tangential injection means includes at least one secondary nozzle 50 having a similar arrangement to primary nozzle 45, only in communication with secondary combustion zone 30. Each secondary nozzle 50 is preferably positioned adjacent downstream side 33 of primary orifice wall 27, and off-center with respect to a centerline axis of secondary combustion zone 30 on combustion chamber side wall 20. It is apparent that either primary tangential injection means or secondary tangential injection means may comprise other suitable components for tangentially injecting the medium into the appropriate combustion zone.

Feedwater circulation means are used to flow feedwater through the water-cooling means, as described above. In one preferred embodiment according to this invention, feedwater circulation means comprises pump 60 having pump discharge 61 in communication with the water-cooling means.

It is apparent that other suitable apparatuses can be used to supply feedwater to the water-cooling means, for example, a natural feed system which operates from gravity and the pressure generated within the feedwater-steam mixture.

Recirculation means are used to recirculate relatively cool exhaust gases from discharge opening 34. In one preferred embodiment according to this invention, the recirculation means includes combustion chamber side wall 20 having inlet opening 23 for admitting exhaust gases discharged through secondary orifice 32, into secondary combustion zone 25. Primary orifice 27 and secondary orifice 32 are very helpful in recirculating the products of combustion within cyclonic combustor 15.

In another preferred embodiment according to this invention, primary refractory ring 26 is secured to inside surface 21, adjacent combustion chamber front wall 22, as shown in FIGS. 2–5. In another preferred embodiment according to this invention, secondary refractory ring 31 is secured to inside surface 21, downstream of and proximate to primary orifice wall 27. It is apparent that the refractory rings described above can extend through at least a portion of each combustion zone.

Cyclonic combustor 15 is preferably positioned, with respect to furnace wall 16, such that primary combustion zone 25 and at least a portion of secondary combustion zone 30 extends from furnace wall 16, outside of the furnace. Such arrangement provides increased overall efficiency of cyclonic combustor 15.

As previously indicated, to insure ultra-low pollutant emissions from cyclonic combustor 15, it is necessary that sufficient quantities of heat be removed from cyclonic combustor 15 by evaporative cooling coil 40 to maintain the temperature within cyclonic combustion chamber at about 1600° F. to about 2400° F. The size, including length, of evaporative cooling coil 40 required is a function of the size of cyclonic combustor 15 and the quantity of fuel burned therein.

Figure 5:
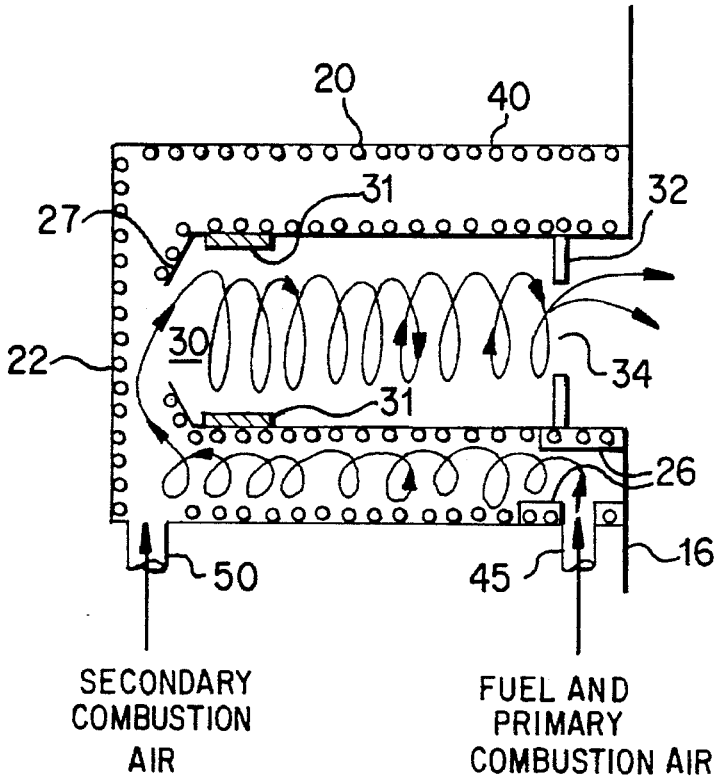
FIG. 5 is a cross-sectional side view of a cyclonic combustor in accordance with yet another embodiment of this invention.

FIG. 5 shows one embodiment of this invention particularly suitable for burning large quantities of fuel while producing ultra-low pollutant emissions. Primary combustion zone 25 is disposed within the primary combustion chamber which comprises an annulus around the secondary combustion chamber in which is disposed secondary combustion zone 30. Primary nozzle 45 is positioned near furnace wall 16. Primary combustion air and fuel tangentially injected into primary combustion zone 25 through primary nozzle 45 flow toward combustion chamber front wall 22. Positioned adjacent to combustion chamber front wall 22 is secondary nozzle 50 through which secondary combustion air is injected tangentially into cyclonic combustor 15. Combustion products from primary combustion zone 25 mix with secondary combustion air and are diverted approximately 180° through primary orifice wall 27 which comprises water-cooled louvers into secondary combustion zone 30. The exhaust gases are discharged from secondary combustion zone 30 through secondary orifice 32 into the furnace.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. An apparatus for cyclonic combustion comprising:

at least one combustion chamber side wall secured to a combustion chamber front wall defining a primary combustion zone and a secondary combustion zone and comprising means for cooling at least a portion of said primary combustion zone and said secondary combustion zone;

a primary orifice wall having a primary orifice secured to said combustion chamber side wall, said primary orifice disposed between said primary combustion zone and said secondary combustion zone and comprising means for cooling said primary orifice wall;

a secondary orifice wall having a secondary orifice secured to said combustion chamber side wall at a discharge end of said secondary combustion zone;

primary tangential injection means for tangentially injecting fuel and primary combustion air into said primary combustion zone, said primary tangential injection means comprising at least one primary nozzle secured to said combustion chamber side wall and in communication with said primary combustion zone; and secondary tangential injection means for tangentially injecting secondary combustion air into said secondary combustion zone.

2. An apparatus in accordance with claim 1 further comprising means for recirculating exhaust gases discharged through said secondary orifice into said secondary combustion zone.

3. An apparatus in accordance with claim 2, wherein said recirculation means comprises said combustion chamber side wall having an inlet opening for admitting said exhaust gases discharged through said secondary orifice into said secondary combustion zone.

4. An apparatus in accordance with claim 1, wherein said combustion chamber front wall comprises means for cooling.

5. An apparatus in accordance with claim 4, wherein said means for cooling said primary orifice wall comprises circulation means for circulating a cooling fluid in heat exchange relationship with said primary orifice wall.

6. An apparatus in accordance with claim 5, wherein said circulation means comprises a plurality of tubular members disposed one of within said primary orifice wall and on the surface of said primary orifice wall.

7. An apparatus in accordance with claim 1, wherein said means for cooling at least a portion of said primary combustion zone and said secondary combustion zone comprises an evaporative cooling coil disposed adjacent an inside surface said combustion chamber side wall.

8. An apparatus in accordance with claim 1, wherein said primary nozzle is positioned adjacent an inside surface of said combustion chamber front wall and off-center, on said combustion chamber side wall, with respect to a centerline axis of said primary combustion zone.

9. An apparatus in accordance with claim 1, wherein said secondary tangential injection means comprises at least one secondary nozzle secured to said combustion chamber side wall and in communication with said secondary combustion chamber.

10. An apparatus in accordance with claim 9, wherein said secondary nozzle is disposed adjacent said primary orifice wall and off-center, on said combustion chamber side wall, with respect to a centerline axis of said oxidizing secondary combustion zone.

11. An apparatus in accordance with claim 1, further comprising a primary refractory ring secured to an inside surface of said combustion chamber side wall, proximate said combustion chamber front wall, within said primary combustion zone.

12. An apparatus in accordance with claim 11, further comprising a secondary refractory ring secured to an inside surface of said combustion chamber side wall, proximate said primary orifice wall, within said secondary combustion zone.

13. An apparatus in accordance with claim 1, wherein said combustion chamber side wall secured to said combustion chamber front wall defines an annular primary combustion zone disposed around said secondary combustion zone.

14. An apparatus in accordance with claim 13, wherein said primary tangential injection means comprises a primary nozzle secured to said one combustion chamber side wall in communication with said primary combustion zone and disposed proximate an upstream end of said primary combustion zone.

15. An apparatus in accordance with claim 13, wherein said secondary tangential injection means comprises a secondary nozzle secured to said combustion chamber side wall disposed proximate said combustion chamber front wall downstream of said primary nozzle and upstream of said primary orifice wall.

16. A process for cyclonic combustion with ultra-low pollutant emissions and high efficiency, comprising the steps of:

tangentially injecting fuel into a reducing primary combustion zone of a cyclonic combustor;

tangentially injecting primary combustion air into the reducing primary combustion zone in an amount equal to about 30% to 90% of a stoichiometric requirement for complete combustion of said fuel;

igniting said fuel/air mixture in said reducing primary combustion zone, forming primary combustion products;

passing said primary combustion products through a primary orifice disposed between said primary combustion zone and an oxidizing secondary combustion zone;

cooling said primary orifice;

tangentially injecting secondary combustion air downstream of said primary orifice into said oxidizing secondary combustion zone of the cyclonic combustor in an amount equal to about 10% to 90% of the stoichiometric requirement;

completing combustion in said oxidizing secondary combustion zone, forming exhaust gases; and cooling at least a portion of a combustion chamber wall defining said reducing primary combustion zone and said oxidizing secondary combustion zone.

17. A process in accordance with claim 16, wherein said fuel and primary combustion air are premixed prior to injection into said reducing primary combustion zone.

18. A process in accordance with claim 16, wherein said primary combustion products passing through said primary orifice are mixed with said secondary combustion air and passed over a secondary refractory ring mounted on an inside surface of said combustion chamber wall downstream of said primary orifice.

19. A process in accordance with claim 16 further comprising recirculating said exhaust gases discharged from said cyclonic combustor to said oxidizing secondary combustion zone.

20. A process in accordance with claim 16 further comprising passing said fuel and said primary combustion air over a primary refractory ring mounted on an inside surface of said combustion chamber wall proximate an upstream end of said reducing primary combustion zone.

21. A process in accordance with claim 16, wherein said exhaust gases are discharged from said combustor through a secondary orifice secured to said combustion chamber wall downstream of said oxidizing secondary combustion zone.

22. A process in accordance with claim 16, wherein said primary orifice and said combustion chamber wall are cooled using water.

* * * * *